US006452564B1

(12) United States Patent
Schoen et al.

(10) Patent No.: US 6,452,564 B1
(45) Date of Patent: Sep. 17, 2002

(54) RF SURFACE WAVE ATTENUATING DIELECTRIC COATINGS COMPOSED OF CONDUCTING, HIGH ASPECT RATIO BIOLOGICALLY-DERIVED PARTICLES IN A POLYMER MATRIX

(75) Inventors: Paul E. Schoen, Alexandria, VA (US); Jonas K. Lodge, Newark, DE (US); Scott Browning, La Plata, MD (US); Daniel Zabetakis, College Park, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/804,643

(22) Filed: Mar. 9, 2001

(51) Int. Cl.[7] ..... H01Q 1/42

(52) U.S. Cl. ..... 343/872; 324/338; 324/342; 428/402.2; 428/408

(58) Field of Search ..... 343/872, 873; 324/323, 338, 342, 356, 359, 339; 428/402.2, 402.24, 408; H01Q 1/42

(56) References Cited

U.S. PATENT DOCUMENTS 5,048,441 A * 9/1991 Quigley ..... 114/90
5,104,508 A 4/1992 Henry et al. ..... 252/500
5,203,911 A 4/1993 Sricharoenchaikit et al. .... 106/1.26
5,212,495 A * 5/1993 Winkel et al. ..... 343/872
5,298,903 A 3/1994 Janos ..... 342/4
5,661,484 A 8/1997 Shumaker et al. ..... 342/1
5,827,997 A 10/1998 Chung et al. ..... 174/35
6,013,206 A 1/2000 Price et al. ..... 264/4.1
6,048,426 A * 4/2000 Pratt ..... 156/177
6,249,261 B1 * 6/2001 Solberg et al. ..... 343/801

* cited by examiner

*Primary Examiner*—Tho Phan
(74) *Attorney, Agent, or Firm*—John J. Karasek; George A. Kap

(57) ABSTRACT

A coating composite is provided for a platform surface of an antenna array for, when applied to the platform, affording isolation of radiating and receiving antennas of the array. The coating composite includes a plurality of conductively coated elongate tubes dispersed in an insulating polymer matrix at a volume loading density approaching that at which the composite begins to conduct electrically over macroscopic distances, i.e., close to the percolation threshold. The tubes are preferably comprised of microtubules comprised of biologically-derived, high-aspect rod-shaped particles of microscopic dimensions having an electroless plated metal coating thereon.

16 Claims, 1 Drawing Sheet

RF SURFACE WAVE ATTENUATING DIELECTRIC COATINGS COMPOSED OF CONDUCTING, HIGH ASPECT RATIO BIOLOGICALLY-DERIVED PARTICLES IN A POLYMER MATRIX

FIELD OF THE INVENTION

The present invention generally relates to radiation absorptive coatings or substrates for providing isolation between RF radiating and receiving antennas and, more particularly, an improved lightweight coating or composite for this purpose.

RELATED ART

Platforms employing RF radiating and receiving antennas use various strategies to isolate the antennas from each other, including the use of absorptive or other coatings on the platform surface. These coatings are designed to reduce or eliminate the propagation of RF energy from one antenna to its neighbors.

Although the present invention is not limited to such application, the problem addressed by the invention may be better understood by referring to FIG. 1, which is a highly schematic representation of a dummy or decoy 10. The decoy 10 includes a receiving antenna 12 which receives a radar signal 14 and which is coupled through a signal processor 16 to a radiating or transmitting antenna 18. The system operates such that when a radar signal is received, transmitting antenna 18 transmits a signal 20 designed to falsely indicate to the radar receiver that the radar return is from an actual target. The receiving and transmitting antennas 12 and 18 are often close together on this and on like platforms and feedback in the form of surface wave energy can impair the system operation.

Currently, the aforementioned surface wave energy, which, as stated, produce unwanted coupling between adjacent antennas, are attenuated by use of composites of ferromagnetic material in a polymer matrix. The composite material commonly used for antenna isolation is MagRAM (magnetic radar absorbing material), a heavy material whose frequency absorption is flat. Such a composite is indicated schematically by composite 22 located between antennas 12 and 18. The amount of absorption by the composite is proportional to the density of magnetic material in the composite and the thickness of the composite and, since magnetic material is heavy, there is a weight penalty to pay. This is an obvious disadvantage in, e.g., a decoy or dummy missile. Considering some patents of interest in the broad field of electrical shielding, U.S. Pat. No. 5,827,997 to Chung et al discloses metal filaments used in a composite for electromagnetic interference (EMI) shielding fabricated by forming a dry mixture of polymer powder and filler in a steel mold. U.S. Pat. No. 5,661,484 to Shumaker et al discloses an artificial dielectric radar absorbing material employing both relatively resistive and conductive filaments which permit frequency dependent, complex permittivities of materials to be produced by the proper selection of dipoles. The lengths of these conductive filaments are less than one half the wavelength of the median frequency of the incident energy in the frequency band to be absorbed.

U.S. Pat. No. 5,298,903 to Janos discloses a synthetic dielectric material for RF ohmic heating using metallic conducting particles of specified shapes and dimensions embedded in a dielectric slab. This heating occurs within the volume of the material in the form of power loss when the phase difference between the conduction current and internal electric field is correspondingly small.

Patents of even more general interest include U.S. Pat. No. 5,104,580 to Henry et al, which discloses a conductive composite polymer film and a manufacturing process therefor which provides for homogeneous placement of conductors in the polymer film to reduce the percolation threshold. U.S. Pat No. 6,013,206 to Price et al discloses formation and metallization of high-aspect lipid microtubules. U.S. Pat. No. 5,203,911 to Sricharoenchaikit et al discloses a controlled electroless plating method wherein the plating thickness on microtubules is controlled through a slow rate of deposition. The general relevance of these patents will become more relevant from the discussions below.

SUMMARY OF THE INVENTION

In accordance with the invention, a lightweight coating composite is provided which has dielectric properties which either absorb or "shed" RF energy traveling along the surface of an antenna platform to prevent one antenna on the platform from coupling with a neighboring antenna on the platform and thereby interfering with the sensitivity thereof.

In accordance with a first aspect of the invention, there is provided a coating composite for a platform surface of an antenna array for, when applied to the platform, providing isolation of radiating and receiving antennas of the array, the coating composite comprising a plurality of conductively coated elongate tubes dispersed in an insulating polymer matrix at a volume loading density approaching that at which the composite begins to conduct electrically over macroscopic distances.

Preferably, the tubes comprise microtubules comprised of biologically-derived, high-aspect rod-shaped particles of microscopic dimensions having an electroless plated conductive coating thereon. Advantageously, the conductively coated elongate tubes have a metal coating. In a beneficial implementation, the metal of said metal coating is selected from the group consisting of nickel and copper.

Preferably, the volume loading density is less than 20%.

In accordance with a further aspect of the invention, there is provided a covering composite for an antenna platform of an antenna array for providing isolation of radiating and receiving antennas of the array, the covering composite comprising a polymer matrix and a plurality of conductive microtubules dispersed within said matrix, the composite having a percolation threshold and the microtubules being dispersed at a volume loading density expressed as the percentage of the volume of the microtubules with respect to the volume of the polymer matrix of no greater than (X−1)% where X% is the volume loading density corresponding to percolation threshold.

Preferably, the microtubules comprise biologically-derived, high-aspect rod-shaped particles of microscopic dimensions having an electroless plated conductive coating thereon. Advantageously, the conductively coated elongate tubes have a metal coating and, in a preferred implementation, the metal coating is selected from the group consisting of nickel and copper.

Preferably, the percentage is less than 20%.

In accordance with yet another aspect of the invention, there is provided, in an antenna platform including antenna array comprising at least one RF radiating antenna and at least one RF receiving antenna separated from said RF radiating antenna so as to define a space therebetween, a composite disposed in the space between said at least one radiating antenna and said at least one receiving antenna for providing electrical absorption of RF energy so as to provide isolation between the antennas, the composite comprising a plurality of conductively coated insulating tubes dispersed in an insulating polymer matrix.

In a preferred embodiment, the composite has a percolation threshold and the tubes are dispersed in the polymer matrix at a volume loading density expressed as a percentage of the volume of the tubes to the volume of the polymer matrix which is close to that corresponding to said percolation threshold. Advantageously, said volume loading density is no greater than (X−1)% wherein X% is the volume loading density corresponding to the percolation threshold. Preferably, the percentage is less than 20%.

As with the other aspects of the invention, the tubes preferably comprise microtubules comprised of biologically-derived, high-aspect rod-shaped particles of microscopic dimensions having an electroless plated conductive coating thereon. The conductively coated tubes preferably have a metal coating and, advantageously, the metal of said metal coating is selected from the group consisting of nickel and copper.

Further features and advantages of the present invention will be set forth in, or apparent from, the detailed description of preferred embodiments thereof which follows.

DESCRIPTION OF THE PREFERRED EMBODIMENTS

As indicated above, composites of ferromagnetic material in a polymer matrix are currently used to attenuate surface currents that produce coupling between adjacent antennas. The present invention employs an alternative to magnetic RF absorption, viz., electrical absorption, in which RF energy induces current in an electrically conductive material and energy is then dissipated as heat by ohmic effects. The wavelength of the RF energy in the composite is inversely proportional to the square root of its permittivity and, to be absorbed, the RF energy must flow as a guided wave within the composite. The invention overcomes a basic problem with this general approach by providing composite wherein the permittivity of the composite is high enough that the RF wavelength is small but wherein the permittivity is small enough to be confined within the composite. Moreover, the dielectric loss of the composite is modest but nonzero, so the composite surface does not resemble a metal which would support a new surface wave. The path length of the composite is long enough that modest absorption per unit length is sufficient to yield substantial antenna isolation.

In accordance with one aspect of the invention, electrically absorptive, very small metal coated tubes or microtubules are provided in the form of an insulating polymer carrier or matrix. The nature of the microtubules is discussed in more detail below.

A further aspect of the present invention concerns the phenomenon of electrical percolation and the production thereby of dielectric effects which can be used for traveling wave attenuation. Percolation occurs in composites in which the density of electrically conductive particles has been raised to a point at which the composite itself becomes conductive, thereby resulting in electrical conduction over large (macroscopic) distances due to contact between adjacent particles. This contact can either be direct between adjacent particles or by virtue of capacitative coupling. The onset of conductivity in such a composite is a second order phase transition, and the permittivity tends to diverge or become very large at the threshold of percolation and the behavior of permittivity at this threshold therefore resembles that of a critical point.

Adding electrically conductive particles or microtubules to an insulating polymer increases the permittivity and conductivity of the resulting composite coating. When sufficient particles are loaded the composite itself will begin to conduct electricity over macroscopic distances. As indicated above, percolation is the onset of this transformation process, and the volume loading of conducting particles is termed the percolation threshold, $P_c$. Percolation is accompanied by substantial changes in dielectric properties. For instance, the real and lossy permittivities both increase as the density of conductive inclusions is raised and at percolation threshold they are about equal over a broad frequency range.

Figure 1:
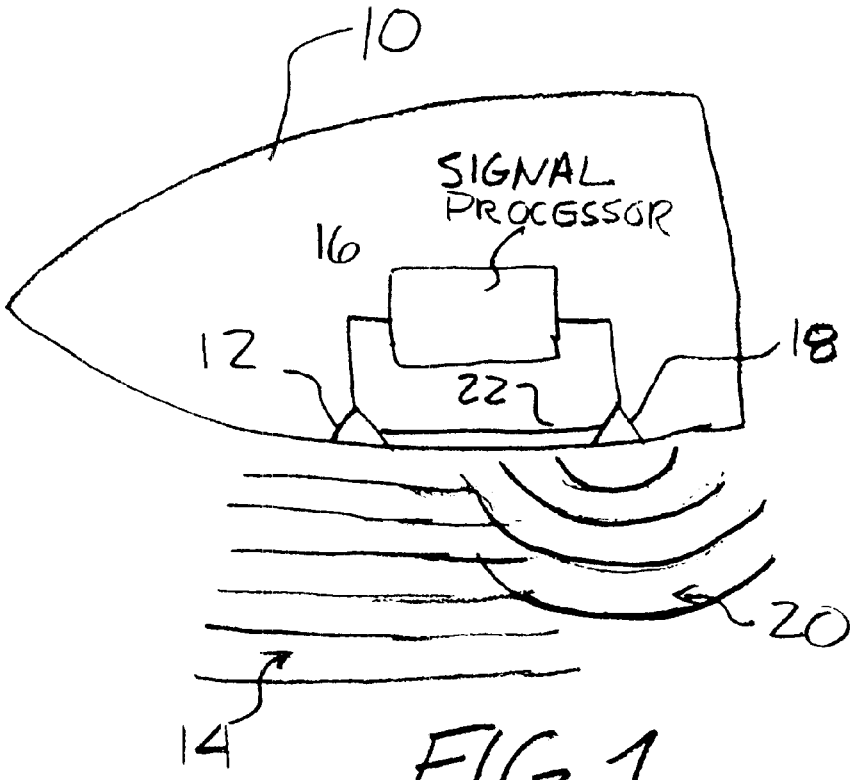
FIG. 1, which was described above, is a schematic diagram of a decoy with transmitting and receiving antennas used in describing the problem sought to be overcome by the present invention and is representative of a platform to which the composite covering or coating of the invention can be usefully applied.
Figure 2:
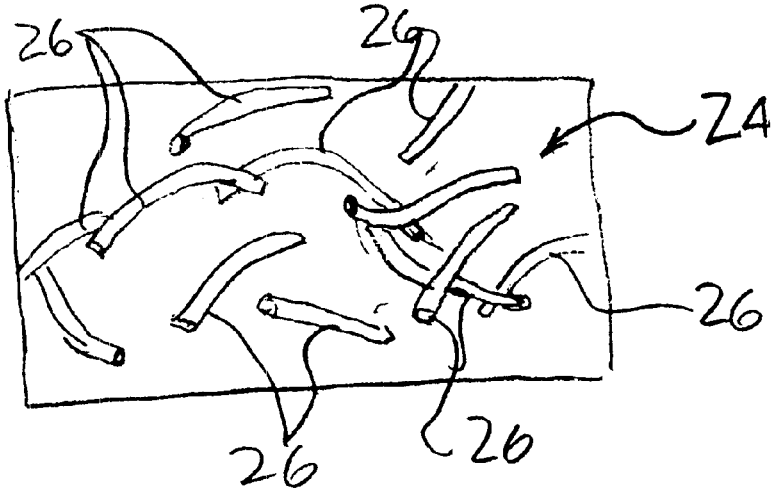
FIG. 2 is a highly schematic representation of a greatly magnified area of a cross section of the composite coating of the invention.

By providing volume loading close to the percolation threshold, the present invention increases the permittivity of the polymer matrix without having to use large amounts of metal particles and thus large particle weights. Further, this effect is significantly increased by using metal particles, i.e., the aforementioned microtubules, which have a high aspect ratio and which produce an entangled, conducting network at lower loading densities. This is indicated in a highly schematic manner in FIG. 2 wherein the insulating polymer matrix is denoted 24 and the microtubules are denoted 26. As indicated above, it is necessary that the particle lengths are small relative to the RF wavelength, even when the wavelength is reduced by the high permittivity of the composite.

Considering the aforementioned microtubules in more detail, these microtubules are preferably a system of biologically-derived, high-aspect ratio, rods or tubes of microscopic dimensions, and are made electrically conductive by electroless plating as discussed above. As indicated above, the microtubules are incorporated into the polymer matrix at loading densities near the percolation threshold and due to the critical divergence of the dielectric properties, the system of microtubules can competitively attenuate RF with about 60% reduction in composite weight relative to the magnetic material currently being used, i.e., the MagRam material mentioned hereinbefore.

The microtubules are based on research done a number of years ago, wherein researchers at the Naval Research Laboratories in Washington, D.C., discovered particles with the size and shape appropriate for percolation. These microtubules are biologically derived, hollow organic cylinders of half-micron diameter and lengths of tens to hundreds of microns. The cylinders are coated with metal to render them conductive by an electroless process. Once metallized, the microtubules can be dried to a powder and dispersed into polymer matrices at varying loading densities to form the composite.

In a preferred embodiment, the microtubules are formed from diacetylenic lipid (1,2 bis(tricosa-10, 12-diynoyl)-sn-glycero-3-phosphocholine), or DC8,9PC. See, for example, A. N. Lagarkov and A. K. Sarychev, Phys. Rev. B 53, 6318 (1996) and F. Behroozi, M. Orman, R. Reese, W. Stockton, J. Calvert, F. Rachfold and P. Schoen, J. Appl. Phys. 68, 3688 (1990). The lipid is dissolved in alcohol at 50° C., water is added, and the temperature lowered to room temperature. The lipid self-assembles itself into microtubules and subsequently precipitates. The particles are rinsed and coated with a palladium catalyst and mixed with metal ions and reductants. In contact with the catalyst, the metal ions-are reduced to neutral metal on the surface of the microtubules and coat the structure with a conductive layer of metal of several tenths of a micron thickness. Several metal species are available for use in this process, but nickel and copper appear to be of greatest potential usefulness for the present invention.

Once the microtubules have been metallized, they can be dried and subsequently mixed into a polymer matrix. The choice of polymer is dependent upon the properties desired for the resulting composite. Among the desirable properties are flexibility, strength, both chemical and environmental stability, and appropriate viscosity to properly disperse the metal powder.

As indicated above, the dielectric properties of composites with rod-shaped inclusions near the threshold are of particular interest here. Recent literature has disclosed the behavior of composites containing high-aspect ratio rods, and has included consideration of the effect of excluded volume. See, for example, I. Balberg, N. Binenbaum and N. Wagner, Phys. Rev. Lett. 17, 1465 (1984); J. Lodge, S. Browning, P. Loschialpo and J. Schelleng, "Magneto-Percolation Materials for LO Applications," Have Forum Low Observables Symposium Proceedings, Vol. 1, Apr. 8–10, 1997 (classified); and 1. Balberg, C. H. Anderson, S. Alexander and N. Wagner, Phys. Rev. B 30, 3933 (1984). Lagarkov and Sarychev (see A. N. Lagarkov and A. K. Sarychev, Phys. Rev. B 53, 6318 (1996)) have developed a formalism termed the effective-mean field theory for conducting stick composites (EMTSC) which predicts permittivities as a function of the loading density of high-aspect ratio particles. In brief, when the volume loading of such composites is increased beyond the percolation threshold, the real permittivity displays a sharp maximum and then tails off to lower values. The lossy permittivity rises quickly in the vicinity of the threshold and continues to rise towards a saturation value for higher loads due to the increase in conductivity of the composite. It is noted that with spherical conducting particles, the threshold for percolation is above 20 volume percent or 33 volume percent according to effective-mean field theory (see A. Celzard, E. McRae, C. Deleuze, M. Dufort, G. Furdin and J. F. Mareche, Phys. Rev. B 53, 6209 (1996)), but with higher aspect-ratio particles such as the microtubules of the invention, the threshold drops significantly.

In a preferred embodiment of the present invention, a dielectric material is provided having absorption in the peak region which is several times greater than that of MagRAM, but is less than half the weight of MagRAM. Sufficient material to produce electrical percolation is expected at microtubule volume loads of less than 20%, or a few tens of grams in a panel one foot square by 0.05 inches thick. The whole panel including polymer and metal particles weighs approximately 200 grams, which is 60% less than an equivalent panel based on magnetic attenuation. At low loading densities, the weight, flexibility and other mechanical properties of the composite are essentially those of the polymer matrix, and these are desirable composite qualities.

The theory for the attenuation performance of such panels is not well developed, but does suggest that panels near percolation should absorb substantially over a narrow bandwidth, whose center frequency would depend on the panel thickness and loading density. Varying these parameters within a panel can be used to broaden the bandwidth.

Although the invention has been described above in relation to preferred embodiments thereof, it will be understood by those skilled in the art that variations and modifications can be effected in these preferred embodiments without departing from the scope and spirit of the invention.

What is claimed is:

1. A covering composite for an antenna platform of an antenna array for providing isolation of radiating and receiving antennas of the array, said covering composite comprising a polymer matrix and a plurality of conductive microtubules dispersed within said matrix, said composite having a percolation threshold and said microtubules being dispersed at a volume loading density expressed as the percentage of the volume of the microtubules with respect to the volume of the polymer matrix of no greater than (X−1)% where X % is the volume loading density corresponding to percolation threshold.

2. The composite of claim 1 wherein said microtubules comprise biologically-derived, high-aspect rod-shaped particles of microscopic dimensions having an electroless plated conductive coating thereon.

3. The composite of claim 1 wherein said conductive microtubules have a metal coating.

4. The composite of claim 3 wherein the metal of said metal coating is selected from the group consisting of nickel and copper.

5. An antenna platform according to claim 1 wherein said percentage is less than 20%.

6. In an antenna platform including antenna array comprising at least one RF radiating antenna and at least one RF receiving antenna separated from said RF radiating antenna so as to define a space therebetween, a composite disposed in the space between said at least one radiating antenna and said at least one receiving antenna for providing electrical absorption of RF energy so as to provide isolation between said antennas, said composite comprising a plurality of conductively coated insulating tubes dispersed in an insulating polymer matrix, wherein said tubes comprise microtubules comprised of biologically-derived, high-aspect ratio rod-shaped particles of microscopic dimensions having an electroless plated conductive coating thereon.

7. The antenna platform according to claim 6 wherein said composite has a percolation threshold and said tubes are dispersed in said polymer matrix at a volume loading density expressed as a percentage of the volume of the tubes to the volume of the polymer matrix which is close to that corresponding to said percolation threshold and said composite is lightweight and has dialectric properties which absorb or "shed" RF energy, wherein said coating is a ferromagnetic material with a thickness of several tenths of a micron, and said microtubules are small relative to the RF wavelength even when the wavelength is reduced by high permittivity of said composite.

8. The antenna platform according to claim 7 wherein said volume loading density is no greater than (X−1)% wherein X % is the volume loading density corresponding to the percolation threshold and wherein said coating is a ferromagnetic material selected from the group consisting of nickel, copper and mixtures thereof and which composite is a dielectric material having absorption in the peak region which is several times greater than that of MagRAM but is less than half the weight of MagRAM.

9. The antenna platform according to claim 7 wherein said percentage is less than 20% and the composite weighs about 60% less than an equivalent composite based on magnetic attenuation, and said microtubules are self-assembled hollow organic cylinders of about half-micron in diameter and tens to hundred microns in length.

10. A coating composite for a platform surface of an antenna array for, when applied to the platform, providing isolation of radiating and receiving antennas of the array, said coating composite comprising a plurality of conductively coated elongate tubes dispersed in an insulating polymer matrix at a volume loading density below that at which the composite begins to conduct electrically over macroscopic distances wherein said tubes comprise microtubules comprised of biologically-derived, high-aspect ratio rod-shaped particles of microscopic dimensions having an electroless plated conductive coating thereon.

11. The composite of claim 10 wherein said conductively coated elongate tubes have a metal coating.

12. The composite of claim 11 wherein the metal of said metal coating is selected from the group consisting of nickel and copper.

13. The composite of claim 10 wherein said volume loading density is less than 20%.

14. The composite of claim 10 which is lightweight and has dielectric properties which absorb or "shed", RF energy, wherein said coating is a ferromagnetic material with a thickness of several tenths of a micron, and said microtubules are small relative to the RF wavelength even when the wavelength is reduced by high permittivity of said composite.

15. The composite of claim 14 wherein said coating is a ferromagnetic material selected from the group consisting of nickel, copper and mixtures thereof and which composite is a dielectric material having absorption in the peak region which is several times greater than that of MagRAM but is less than half the weight of MagRAM.

16. The composite of claim 15 which weighs about 60% less than an equivalent composite based on magnetic attenuation, and said microtubules are self-assembled hollow organic cylinders of about half-micron in diameter and tens to hundred microns in length.

* * * * *